US005350240A

United States Patent [19]

Billman et al.

[11] Patent Number: 5,350,240

[45] Date of Patent: Sep. 27, 1994

[54] STAND-UP POUCH HAVING CROSS-SEAL FEATURE AND METHOD OF MAKING

[75] Inventors: Fred L. Billman, Caledonia Township, Racine County, Wis.; Russell B. Wortley, Waukegan, Ill.

[73] Assignee: S. C. Johnson & Son, Inc., Racine, Wis.

[21] Appl. No.: 924,135

[22] Filed: Dec. 17, 1991

Related U.S. Application Data

[63] Continuation-in-part of Ser. No. 532,296, Jun. 1, 1990, abandoned.

[51] Int. Cl.[5] ..... B65D 30/10

[52] U.S. Cl. ..... 383/104; 383/94; 383/122; 493/189

[58] Field of Search ..... 383/10, 104, 94, 43, 383/122; 493/189, 199, 244, 254; 229/103.1, 116

[56] References Cited

U.S. PATENT DOCUMENTS

| | | | |
|---|---|---|---|
| 2,265,075 | 12/1941 | Knuetter . | |
| 2,341,056 | 2/1944 | Moore | 229/116 |
| 2,707,581 | 5/1955 | Kaplan et al. | 383/43 |
| 2,821,337 | 1/1958 | Morgan, Jr. . | |
| 2,936,940 | 5/1960 | Berghgracht . | |
| 2,999,627 | 9/1961 | Reinhardt | 383/104 |
| 3,009,498 | 11/1961 | Fohr . | |
| 3,090,175 | 5/1963 | Berglund . | |
| 3,136,475 | 6/1964 | Geimer . | |
| 3,172,796 | 3/1965 | Gulker | 383/122 |
| 3,380,646 | 4/1968 | Doyen et al. | 383/104 |
| 3,412,918 | 11/1968 | Sherman . | |
| 3,437,016 | 4/1969 | Malby et al. . | |
| 3,437,258 | 4/1969 | Kugler . | |
| 3,438,567 | 4/1969 | Bell, Jr. . | |
| 3,502,521 | 3/1970 | Doyen et al. . | |
| 3,799,914 | 3/1974 | Schmit et al. | 383/104 |
| 3,935,993 | 2/1976 | Doyen et al. . | |
| 3,980,225 | 9/1976 | Kan . | |
| 4,023,700 | 5/1977 | Buquet et al. . | |
| 4,041,851 | 8/1977 | Jentsch . | |
| 4,055,109 | 10/1977 | Kan . | |
| 4,353,497 | 10/1982 | Bustin . | |
| 4,454,979 | 6/1984 | Ikeda et al. . | |
| 4,537,308 | 8/1985 | Hollander, Jr. . | |
| 4,718,738 | 1/1988 | Bell . | |
| 4,721,396 | 1/1988 | Sengewald . | |
| 4,795,271 | 1/1989 | Lane, Jr. et al. . | |
| 4,837,849 | 6/1989 | Erickson et al. . | |
| 4,978,232 | 12/1990 | Dunton | 383/104 |

FOREIGN PATENT DOCUMENTS

| | | | |
|---|---|---|---|
| 1065320 | 9/1959 | Fed. Rep. of Germany | 383/122 |
| 2142276 | 1/1973 | France | 383/122 |
| 8912006 | 12/1989 | PCT Int'l Appl. | 383/104 |
| 0823855 | 11/1959 | United Kingdom | 383/122 |
| 870551 | 6/1961 | United Kingdom | 383/94 |

*Primary Examiner*—Stephen P. Garbe

[57] ABSTRACT

A one-piece flexible-plastic fluid container or pouch (130), adapted for containment of a fluid, is disclosed. The pouch (130) comprises a bottom (135) and a pair of sidewalls (132 and 133) that are unitary with the bottom (135). Each sidewall (132 and 133) includes edge margins disposed transverse to the bottom (135) and an end margin located in distal relation to the bottom (135). The edge margins of one sidewall (132), when joined in a fluid-tight manner to the respective edge margins of the other sidewall (133), define a pair of spaced-apart fluid-tight sideseams (136 and 138). Each sideseam (136 and 138) has a respective end portion (140 and 142) that is opposite the bottom (135). A portion of each sidewall end margin (144 and 146) when joined in a fluid-tight manner to the respective remainder portion (145 and 147) thereof and the sideseam end portions (140 and 142) opposite the bottom (135) when proximally joined together in a fluid-tight manner collectively define a fluid-tight endseam (150). The pouch (130) further comprises a sleeve (137). The sleeve (137) is unitary with the bottom (1352) and the sidewalls (132 and 133); and the sleeve (137) circumscribes the bottom (135). The sleeve (137) and sidewalls (132 and 133) possess sufficient stiffness for enabling the sidewalls (132 and 133) to remain generally upright relative to a horizontal surface when the sleeved, bottom end (134) of the pouch (130) is placed on such a surface. Also disclosed is a method of making the fluid container or pouch (130).

1 Claim, 5 Drawing Sheets

STAND-UP POUCH HAVING CROSS-SEAL FEATURE AND METHOD OF MAKING

This application is a continuation-in-part of U.S. application Ser. No. 07/532,296 (now abandoned) filed 1 Jun. 1990, the benefit of which filing date is now claimed for priority purposes pursuant to 35 USC §120.

TECHNICAL FIELD

Our present invention is directed to a flexible-plastic pouch for containment of a liquid. Our pouch is so formed from flexible-plastic material as to have a unitary base portion which allows the liquid container or pouch to stand upright. The liquid container or pouch also includes a pair of opposed sideseams for sealing the sides of the pouch in a fluid-tight manner. A so-called "cross-seal", at the top of the pouch, so seals the pouch that the upper portions of the pouch sideseams are touching or nearly touching. Such a cross-seal serves to seal the upper margin of the pouch fluid-tight manner.

Our present invention is also directed to methods of making various embodiments of such a pouch.

BACKGROUND ART

Stand-up pouches, made of flexible plastic material, are generally well-known. See, e.g., U.S. Pat. No. 2,936,940 to Berghgracht as well as U.S. Pat. No. 3,380,646 to Doyen et al. Briefly, such a pouch includes a base portion that is so designed as to provide the pouch with a stand-up feature. The opposed side edge margins of the pouch include a pair of sideseams; and the upper edge margin of the pouch includes a topseam. Such a topseam typically runs from one side of the pouch upper margin to the other side of the upper margin.

For a variety of reasons, liquid-containing pouches have gained wide popularity of late. Indeed, it has come to our attention that some form or variety of a liquid-containment pouch is currently available in virtually every major marketplace throughout the world. Commonly-contained fluids include home-maintenance products such as liquid dish-washing and laundry detergents, liquid so-called "pre-spotting" fluids, and the like, as well as personal-care products such as shampoos, hair conditioners, shower gels, and the like.

Commercially-available flexible-plastic liquid containers or pouches—containing the above-mentioned as well as other sorts of liquids—may be transparent, translucent, or opaque, as desired by the pouch manufacturer, generally for purposes of catching the eye of the consumer.

In the relatively fast-paced world in which we live, many people, it seems, are devoting less time to shopping and more time to the pursuit of other interests. As a result, certain pouch manufacturers are devoting greater amounts of time to enhancing the aesthetic and eye-catching appearance of their fluid-containing pouches so that consumers with limited shopping time will preferentially choose their pouch rather than the pouch of a competitor.

It is our opinion that such enhancement must inevitably make the pouch relatively more viewable (i.e., "noticeable") in a similar setting than is the pouch of a competitor.

For example, most commercially-available fluid-containing pouches include some sort of external "indicia" such as a trademark, a description of the product contained, and so forth. Depending upon shelf-space location, degree and amount of lighting, and amount of shelf-area allocated to a particular product relative to shelf-area allocated to the product of a competitor, a consumer may not notice or "see" a particular product that—in fact—is closely positioned (on a store shelf with respect to eye level, for example) relative to a similar-use product of a competitor.

Further in that regard, we have noticed that many" of the commercially-available fluid-containing pouches presently standing upright on such shelves typically tend to possess contorted or "warped" surfaces. That is, of the various stand-up types of liquid-containing pouches which we observed as "for sale" on the shelves of retailers, wholesales and other distributors, the curved surfaces of such pouches typically possess surface-curvature irregularities which tend to adversely affect the eye-catching ability or "quality" of the pouch. We have noticed, in particular, that the degree of surface distortion can, at times, be so severe as to almost render the oftentimes colorful external indicia of the pouch unnoticeable. We presently postulate, therefore, that lighting on a distorted surface as well as distorted indicia on the external surface of the pouch are probably principal factors in this regard. In any event, our laboratory-test results clearly indicate that an indicia-carrying curved surface that is generally free of surface distortion is invariably more noticeable, from the standpoint of product "recognition" (for purposes of making a quick selection), than is an indicia-carrying curved surface that possesses surface distortion.

Thus it is desirable to provide a stand-up pouch having a curved surface that is generally free of surface "warpage" as well as other surface distortion.

It is also desirable that such a pouch have a "base" portion which does not weaken over time so that the stand-up pouch is able to be stored in a vertical manner or fashion without, for example, leakage of the pouch contents occurring over the time period that such pouch is stored, and without undesired "tilting" or "leaning" of the pouch occurring over such a period of time.

Our present invention provides a fluid-containing pouch possessing a curved surface that is virtually free of surface distortion. Our present invention also provides a fluid-containing pouch possessing a structurally-sturdy stand-up base portion. Our present invention therefore provides both of the above-discussed features and/or advantages (which would be desirable for stand-up pouches). Moreover, our present invention possesses various other features and/or advantages, as will be discussed below in greater detail.

SUMMARY DISCLOSURE OF INVENTION

One aspect of our present invention is directed to a flexible-plastic fluid container or pouch. Another aspect of our present invention is directed to a method of making such a fluid container or pouch.

The pouch comprises a bottom and a pair of sidewalls that are unitary with the bottom. Each such sidewall includes edge margins disposed transverse to the bottom as well as an end margin that is located in distal relation to the bottom. The edge margins of one sidewall when joined in a fluid-tight manner to the respective edge margins of the other sidewall define a pair of spaced-apart fluid-tight sideseams. Each such sideseam has a respective end portion that is located opposite the bottom. A portion of each sidewall end margin when joined in a fluid-tight manner to the remainder portion thereof and the sideseam end portions opposite the bottom when proximally joined together in a fluid-tight manner collectively define a fluid-tight endseam. (Such an endseam is herein referred to as a "cross-seal".) The pouch further comprises a sleeve. The sleeve is unitary with the pouch bottom as well as the sidewalls; and the sleeve circumscribes the bottom. The sleeve and sidewalls are of sufficient thickness and possess sufficient stiffness for enabling the sidewalls to remain generally upright relative to a horizontal surface when the sleeved, bottom end of the pouch is placed on such a surface.

There are several ways of making our novel fluid container or pouch. In one such method, which comprises a series of steps, the first step is to fold a portion of an elongated piece of flexible-plastic material onto the remainder portion thereof in a manner so as to form at least three spaced-apart folds of alternating orientation transversely-disposed in the plastic material between the ends thereof while also forming a pair of sidewalls respectively unitary with the outermost two of the three folds. Another step is to superpose one of the two sidewalls above the other, and to form in the flexible-plastic material a gusseted base in the vicinity of the folds. Still another step is to join edge margins of the folds and respective sidewalls together in a fluid-tight manner for forming in the flexible-plastic material a pair of spaced-apart fluid-tight sideseams, wherein the sideseam ends that are spaced from the gusseted base are closer together than are the sideseam ends which are adjacent to the base. Yet another step is to join a portion of an end margin of each of the sidewalls in a fluid-tight manner to the remainder portion thereof while proximally joining together in a fluid-tight manner sideseam end portions opposite the base, for forming in the sidewall end margin a fluid-tight endseam. (This particular step describes one method of forming the above-mentioned "cross-seal" of the pouch summarized hereinabove.)

Other aspects, features and advantages of our present invention are discussed in greater detail hereinbelow.

INDUSTRIAL APPLICABILITY

We have found the fluid container or pouch of our present invention to be suitable for purposes of containing virtually any pourable fluid or pourable powder, including but not limited to various automobile-maintenance fluids, various commercial-maintenance fluids, various fluid foodstuffs, various household-maintenance fluids, various personal-care fluid products, and so forth.

For example, we have found the fluid container or pouch of the present invention to be suitable for purposes of containing a motor vehicle maintenance fluid such as an automobile-body cleaner, an automobile-tire cleaner, an automobile-upholstery cleaner, an automobile-vinyl cleaner, and the like. The above-recited term "automobile" is hereby understood to be construed so broadly as to include various maintenance fluids, analogous to those specific maintenance fluids recited immediately above for "automobiles", for various other types of motor vehicles. The fluid container or pouch is thus suitable for containing methanol-containing seasonal liquid-fuel additives, motor oil, power-steering fluid, radiator heating/coolant fluid, transmission fluid, various lubricants, windshield-washer fluid, and the like.

Examples of various commercial-maintenance fluids, that are suitable for containment by the fluid container or pouch of our present invention, include but are not limited to commercial dishwashing detergents, floor polishes, heavy-duty liquid laundry detergents, surface cleaners, various liquid disinfectants, various machine-cleaning fluids, and various surface-stripping fluids.

Examples of fluid foodstuffs, suitable for containment by the fluid container or pouch of the present invention, include distilled water, ketchup, mayonnaise, milk, mineral water, mustard, pourable jellies, various cooking oils, various dessert toppings, various fruit juices, various liquid beverages, various salad dressings, various sauces, various vegetable juices, vinegar, yogurt, and the like.

Examples of household-maintenance fluids, suitable for containment by the fluid container or pouch of the present invention, include but are not limited to disinfectants, floor strippers, glass cleaners, liquid and pourable powdered dishwashing detergents, liquid surface coatings including liquid "waxes", paints, surface cleaners, surface polishes, varnishes, various toilet-cleaning liquid products, and various laundry-care products such as bleach, dry-cleaning fluids, fine-fabric and other liquid detergents, liquid so-called "fabric" softeners, liquid so-called "laundry pre-spotters", liquid "spot removers", and the like.

Examples of personal-care fluids, that are suitable for containment by the fluid container or pouch of the present invention, include but are not limited to creams, emollients, hair conditioners, hair gels, hair-styling liquids, hand cleaners, lotions, mouthwash, oils, shampoos, showering gels, skin-care products, tooth-cleaning gels and toothpaste, various medicinal liquids, and the like. (The term "personal-care" products includes special products for adults and infants as well as older children.)

A suitable flexible-plastic material, utilized to make the fluid container or pouch of the present invention, may at times thus need to be so chosen as to be especially compatible with a particular fluid that is to be contained. For example, special consideration may need to be given to the particular flexible-plastic material that is chosen to make the fluid container or pouch of the present invention for purposes of effectively containing and/or maintaining desired purity of certain "special handling" fluids such as baby oil, bleach, milk, motor oil, toilet cleaners, vinegar, yogurt, and the like.

BRIEF DESCRIPTION OF THE DRAWINGS

Hereinafter, the term "FIG." shall be understood to be an abbreviation, referring to a particular accompanying drawing figure.

Throughout the drawings, like reference numerals refer to like parts.

BEST MODE FOR CARRYING OUT THE INVENTION

While our present invention will now be described with reference to a number of illustrated preferred embodiments, it is to be understood that our present invention is not to be limited to the accompanying illustrated embodiments. On the contrary, as those skilled in the pouch art can well appreciate, our present invention is to be understood to cover all structural as well as all functional alternatives and equivalents, as are defined by the appended claims.

Figure 1:
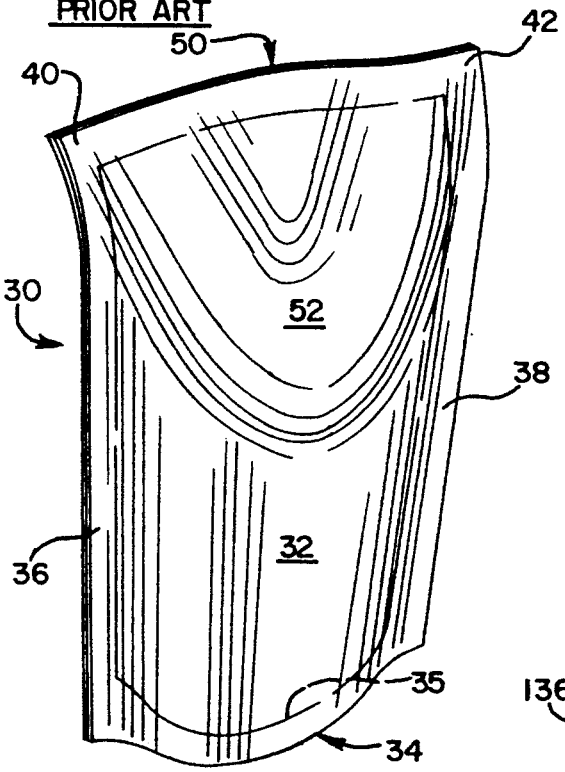
FIG. 1 PRIOR ART
FIG. 1 is a perspective view of a prior art pouch.

FIG. 1 depicts a commercially-available fluid-filled stand-up pouch 30. The prior-art pouch 30 is made of a commercially-available flexible-plastic material. The prior-art pouch 30 includes a front sidewall 32, a rear sidewall (not directly viewable from FIG. 1), and a base 34. The base 34 includes a pouch bottom 35. The base 34 is so formed as to enable the fluid-containing pouch 30 to stand upright on a surface. Spaced-apart edge margins of the front sidewall 32 and rear sidewall are so joined together in a fluid-tight manner as to produce a pair of spaced-apart fluid-tight sideseams 36 and 38. Upper edge margins of the front sidewall 32 and rear sidewall are so joined together in a fluid-tight manner as to form a fluid-tight seal 50 along the upper margin of the prior-art pouch 30, from an upper portion 40 of the one sideseam 36 to an upper portion 42 of the other sideseam 38. The illustrated prior-art pouch 30 would be substantially rectangular if the fluid were to be removed from the pouch 30 and the pouch 30 flattened. The prior-art pouch 30, when containing fluid and positioned on its base 34 as shown in FIG. 1, is seen to include a sidewall portion 52 along its upper margin wherein the curvature is different from the sidewall curvature appearing immediately therebelow.

In many prior-art stand-up pouches reviewed by us, the upper sidewall portion—similar to the illustrated upper sidewall portion 52—includes surface distortion as well as other surface deformities. Such surface deformities are generally undesirable because they tend to interfere with the ability of the indicia-bearing external surface of such a stand-up pouch to readily catch the eye of a consumer. As was briefly noted above, a number of liquid products of various manufacturers, contained in stand-up pouches of this sort of design, shape and appearance, will be competing with each other, literally for the eye of the consumer. As was also noted above, visual appearance, pouch aesthetics, and, above all, the ability of the external indicia (not shown) on the pouch sidewall to be clearly and quickly recognized by a consumer are of paramount importance when one considers that many consumers make a selection from a variety of competing products in a very short period of time (e.g., 0.1 to 1.5 seconds).

Our novel, stand-up fluid container or pouch will now be described in detail. FIGS. 2 through 6 show one embodiment of our novel fluid container or pouch 130.

Accordingly, the illustrated embodiment of our novel pouch 130 is seen to include a front sidewall or surface 132, a rear sidewall or surface 133 (FIGS. 2 and 6), and a base 134. The base 134 comprises a pouch bottom 135.

The shape of the base may vary.

Figure 9:
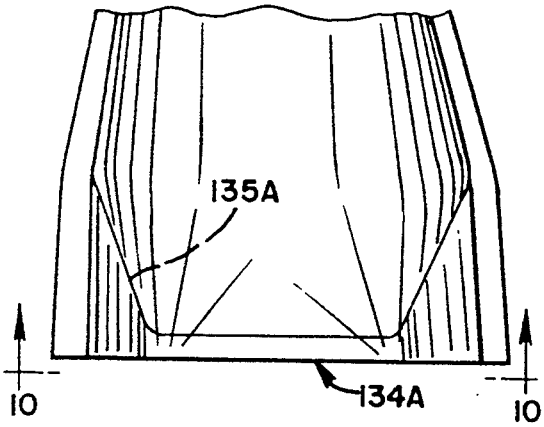
FIG. 9 is a front elevational view, partially fragmented and on a reduced scale relative to FIG. 5, illustrating yet another embodiment of the base of the pouch of our invention.
Figure 11:
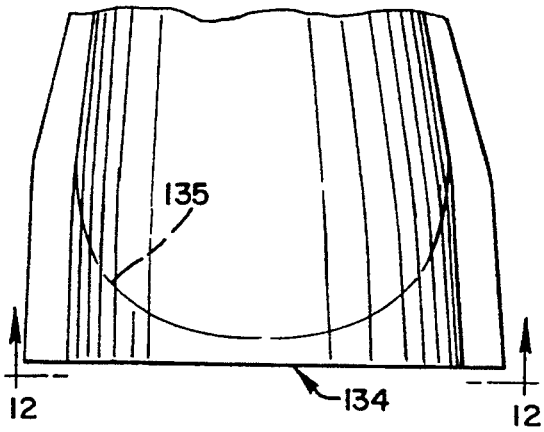
FIG. 11 is yet another front elevational view, also partially fragmented and on a reduced scale relative to FIG. 5, illustrating still another embodiment of the pouch base.
Figure 10:
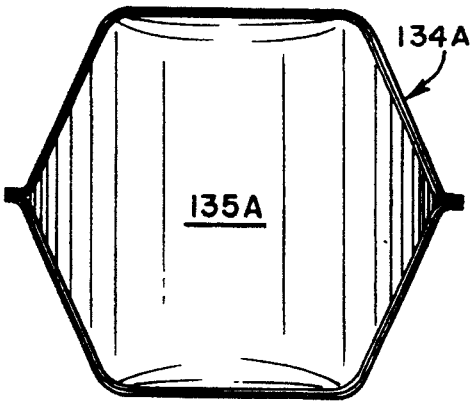
FIG. 10 is a bottom plan view taken from the plane 10—10 in FIG. 9.
Figure 12:
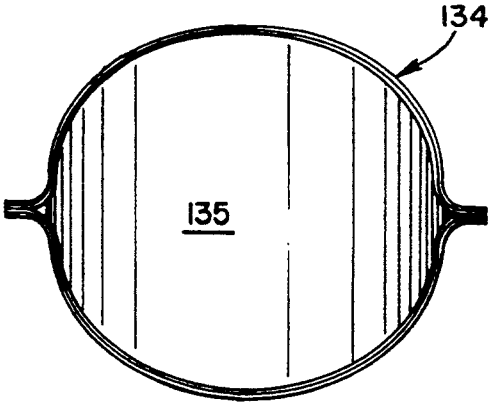
FIG. 12 is a bottom plan view taken from the plane 12—12 in FIG. 11.

For example, the pouch bottom 135A may define a generally hexagonal base 134A, as is shown in FIGS. 9 and 10; or, if desired, the pouch bottom 135 may define a generally elliptical base 134, as is shown in FIGS. 11 and 12. Those skilled in the art can therefore well appreciate that the pouch bottom and sleeve may define a generally circular base (not shown), if desired.

The front and back sidewalls 132 and 133 (FIGS. 2 and 6) are unitary with the bottom 135, as will be discussed in greater detail, below, in connection with FIG. 16. Each such sidewall 132 and 133 includes edge margins that are disposed transverse to the bottom 135. Each such sidewall 132 and 133, furthermore, includes an end margin that is located in distal relation with respect to the bottom 135. The edge margins of one sidewall 132, when joined in a fluid-tight manner to the respective edge margins of the other sidewall 133, define a pair of spaced-apart fluid-tight sideseams 136 and 138. Each such sideseam 136 and 138 has a respective end portion 140 and 142 that is located opposite the bottom 135 of our novel pouch 130.

Figure 2:
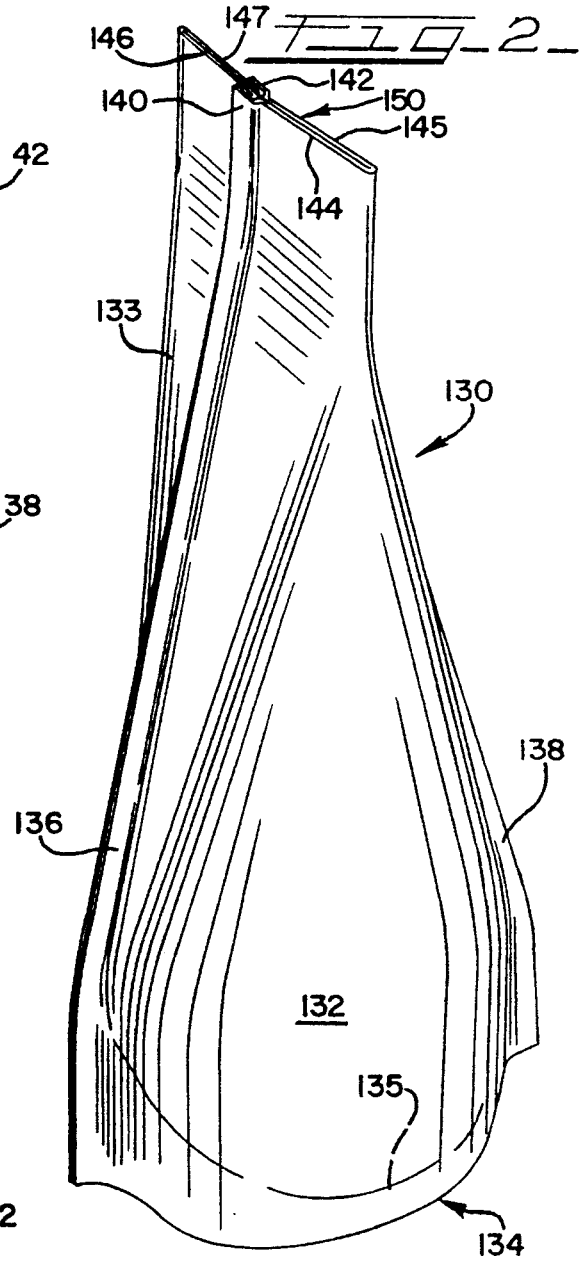
FIG. 2 is a perspective view of one embodiment of the pouch of our invention, illustrating one embodiment of the "cross-seal" along the upper margin thereof.
Figure 3:
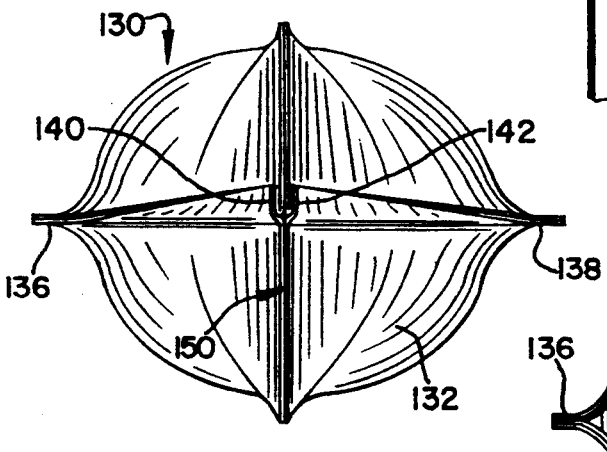
FIG. 3 is a top plan view of the pouch shown in FIG. 2.
Figure 4:
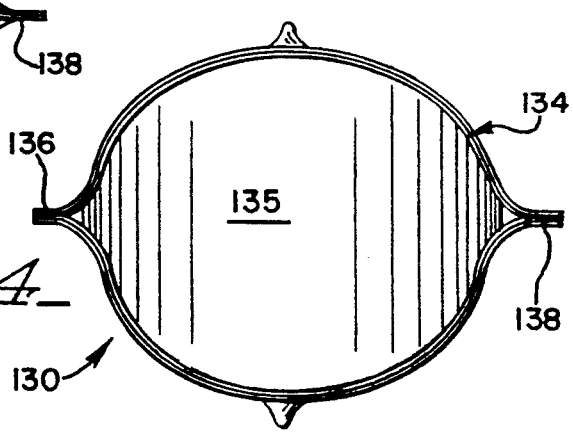
FIG. 4 is a bottom plan view of the pouch embodiment shown in FIG. 2.
Figure 5:
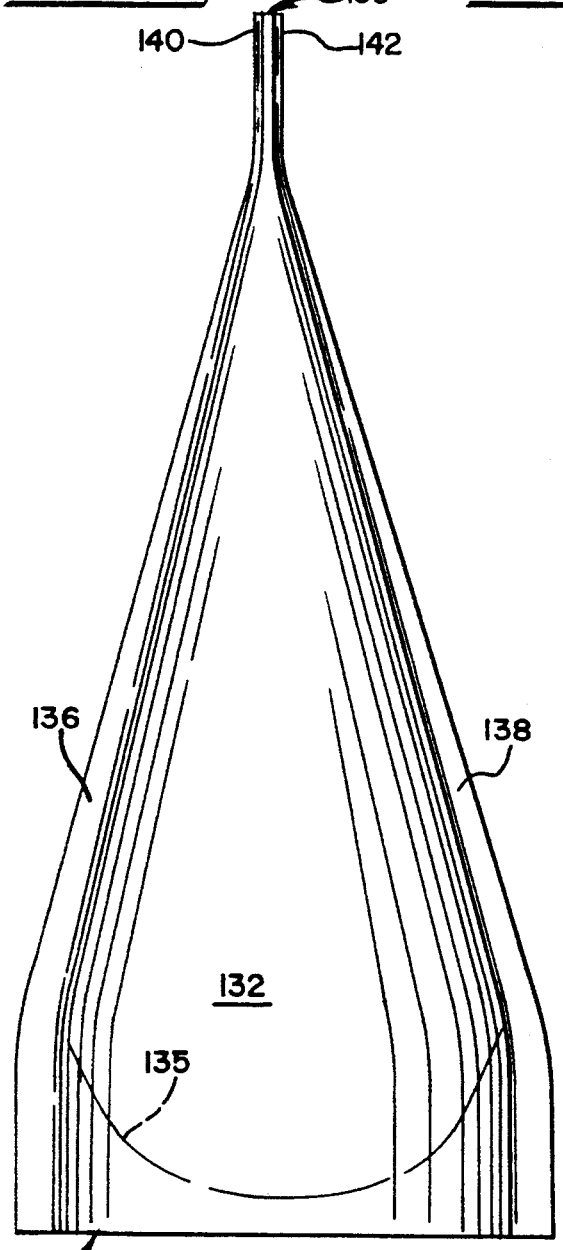
FIG. 5 is a front elevational view of the pouch embodiment shown in FIG. 2, illustrating one embodiment of the pouch base, otherwise shown in perspective view in FIG. 2.
Figure 6:
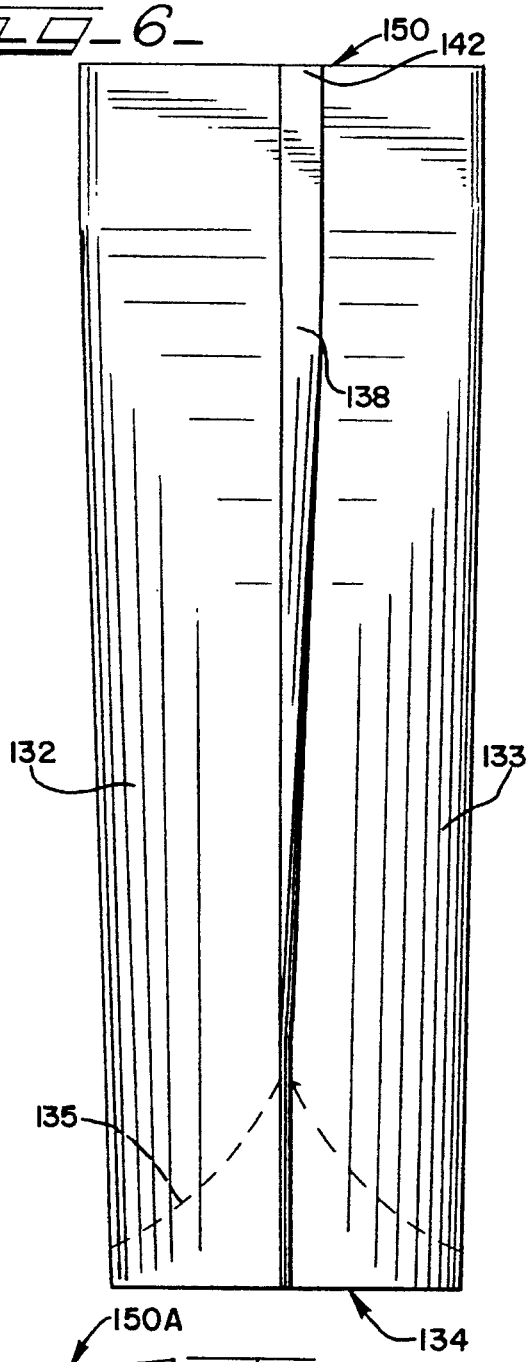
FIG. 6 is a side elevational view of the pouch embodiment shown in FIGS. 2 through 5.

A fluid-tight endseam 150, shown e.g. in FIG. 2, is formed when three conditions are met, namely (1) when an end portion 144 (FIG. 2) of the sidewall 132 is joined in a fluid-tight manner to the remainder portion 145 thereof, (2) when an end portion 146 of the sidewall 133 is joined in a fluid-tight manner to the remainder portion 147 thereof, and (3) when the sideseam end portions 140 and 142 (opposite the bottom 135), are all proximally joined together in a fluid-tight manner. (See also FIG. 8.) These three conditions thus collectively define the conditions which form the fluid-tight endseam 150, shown in FIG. 2.

With respect to our novel pouch, we refer to the fluid-tight endseam 150 as our novel "cross-seal" feature.

Figure 8:
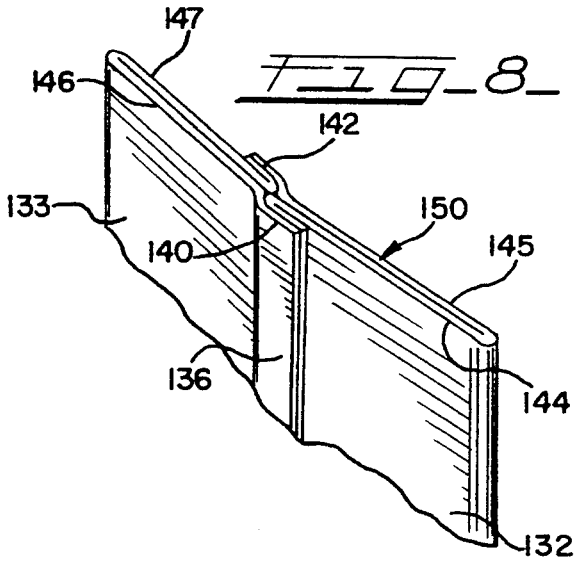
FIG. 8 is a perspective view, partially fragmented and on an enlarged scale relative to FIG. 2, illustrating still another embodiment of the upper-marginal "cross-seal" feature of the pouch of our invention.

The endseam 150 thus may be formed (as described above), where the respective end portions 140 and 142 of the sideseams 136 and 138 are folded in the same direction (see, e.g., FIGS. 2 and 3); or the endseam may otherwise be formed, as in the case where the end portions 140 and 142 are folded in opposite directions. (Please compare FIGS. 2 and 8.) Furthermore, in the case where the end portions 140 and 142 are folded in opposite directions, those skilled in the art can appreciate that it may be desirable, in certain instances, to so form the endseam 150 as to cause the folded over end portions 140 and 142 of the respective sideseams 136 and 138 to be spaced apart by a distance that is greater than what is shown in FIG. 8; or it may be desirable to so form the endseam 150 as to cause the end portions 140 and 142 of the respective sideseams 136 and 138 to overlie each other, similar to the overlying relation shown in FIG. 2 but folded-over in opposite directions as is shown in FIG. 8.

Figure 7:
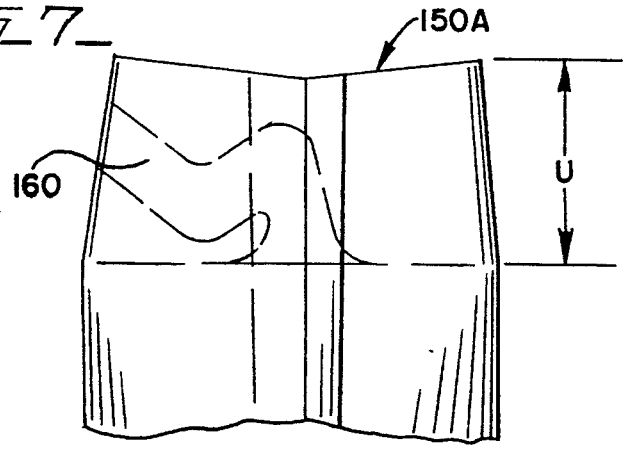
FIG. 7 is a side elevational view, partially fragmented, of another embodiment of the pouch of our invention, showing a spout-defining upper-marginal "cross-seal" portion thereof.

Moreover, if desired, the pouch end margin defining the endseam 150A may be so formed as to further define a spout 160 (FIG. 7). Such a spout 160 is in fluid communication with the fluid contained within the pouch 130. Except for the upper portions of the pouch sidewalls defining the spout 160, the remainder of the upper portions of the pouch sidewalls are sealed together along an upper margin, "U", as is also shown in FIG. 7. Still further, the spout 160 may be of generally serpentine shape, if desired, as is also shown in FIG. 7.

The thickness of the sidewalls 132 and 133, and the thickness of the particular type of flexible-plastic material that is utilized to make the fluid container or pouch, are all suitable for providing the sidewalls 132 and 133 with sufficient stiffness for enabling the pouch sidewalls 132 and 133 to remain generally upright relative to a horizontal surface when the sleeved, bottom end (i.e., the base 134) of the pouch 130 is placed on a horizontal surface.

Furthermore, the pouch 130 is typically manufactured of a commercially-available multi-layered film, certain layers of which are liquid-impermeable, and when required gas-impermeable. In particular, as those skilled in the art well know, the compositional makeup of the pouch sidewalls are generally so selected from commercially-available multi-layered films such that the pouch-contained liquid contents do not undergo noticeable weight loss when stored at room temperature (i.e., about 25° C.) over a period of about 1 year. In this regard, commercially-available multi-layered pouches are well-known in the art. See, for example, U.S. Pat. No. 3,980,225 to Kan; U.S. Pat. No. 4,023,700 to Buquet et al.; U.S. Pat. No. 4,454,979 to Ikeda et al.; and U.S. Pat. No. 4,837,849 to Erickson et al.

Figure 16:
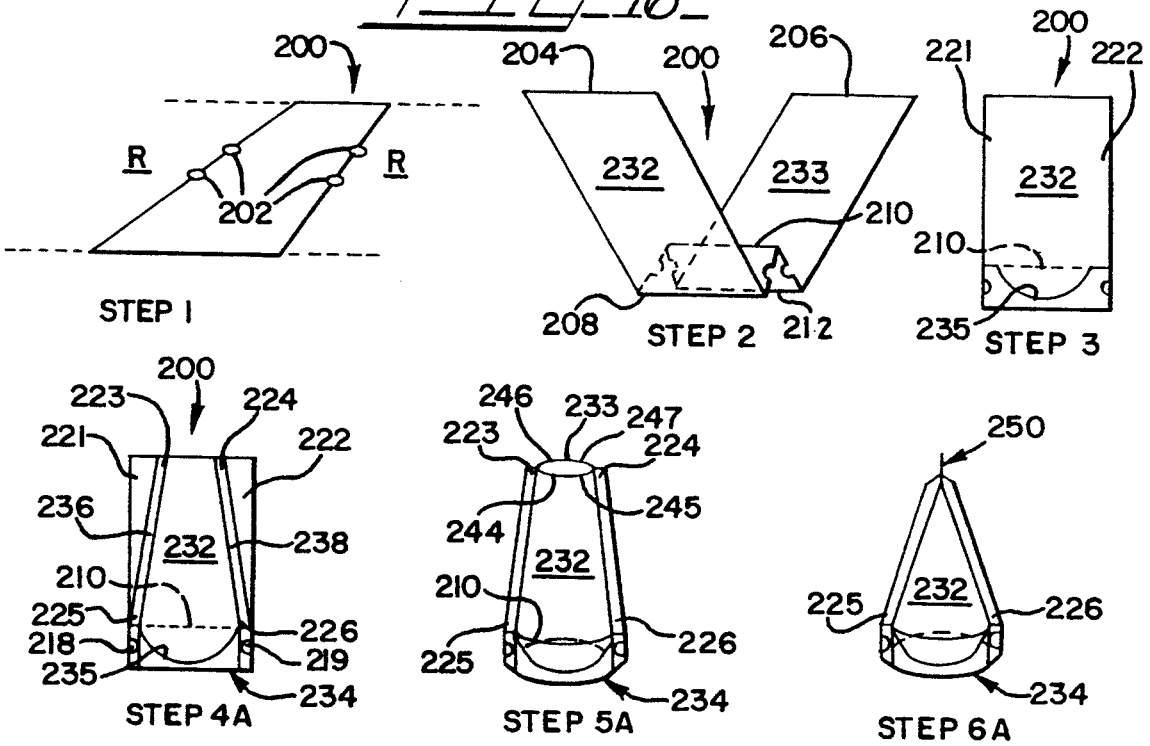
FIG. 16 is a schematic illustration a schematic diagram illustrating one method of making the pouch embodiments of our invention.
Figure 17:
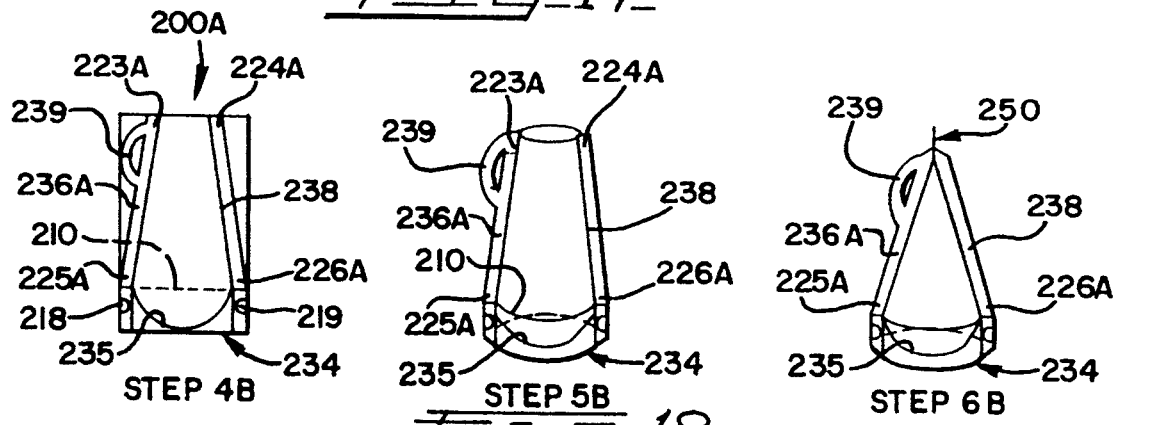
FIG. 17 is a schematic diagram illustrating a second embodiment for the method steps 4, 5 and 6 of our invention.
Figure 18:
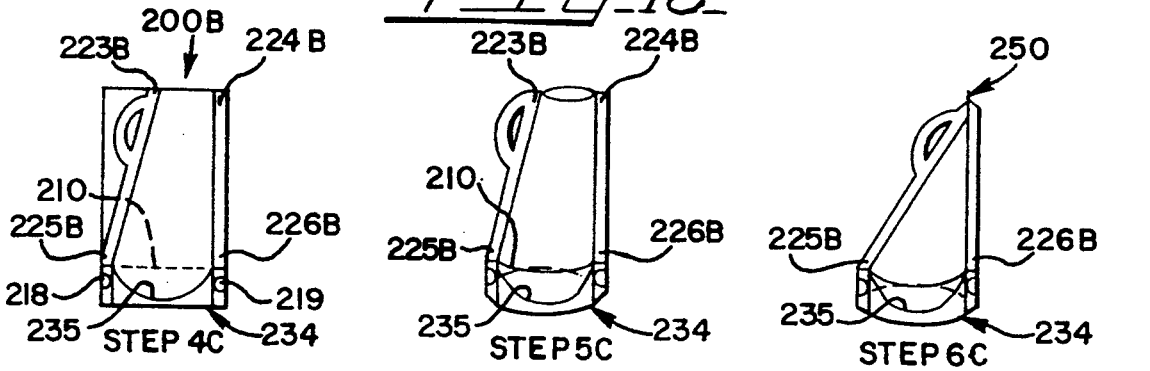
FIG. 18 is a schematic diagram illustrating a second embodiment for steps 4, 5 and 6 of our invention.

The reader's attention is next invited to FIGS. 16, 17 and 18, so that the illustrated, preferred methods of making cur novel fluid container or pouch can be discussed. We will first show, in detail, how laboratory-produced pouches were made; and then, utilizing the steps presented in FIG. 16, discuss the presently preferred mass-production methods. In the immediately-following discussion, the parenthetically-noted "steps" will refer to what is shown in FIG. 16.

Accordingly, as is shown in FIG. 16, an elongated piece 200 of sealable flexible-plastic material is first cut, torn, or otherwise separated from the remainder ("R") of the flexible-plastic material. (STEP 1.)

However, prior to being thus-separated, we on occasion have found it desirable to form circular apertures or holes 202 at preselected, spaced-apart central locations throughout the flexible-plastic material (as is shown in STEP 1); and, after doing so, we on occasion have found it further desirable to so form the elongated pieces 200 as to bisect the circular holes 202 when thus separating the elongated piece 200 of flexible-plastic material from the remainder ("R") of the flexible-plastic material. The illustrated holes 202, which are optional, are utilized to make the illustrated, preferred embodiment of the pouch base, as will be discussed in greater detail, further below.

As was mentioned above, the elongated piece 200 of flexible-plastic material is typically manufactured of a commercially-available multi-layered film. In particular, as those skilled in the art well know, facing layers, often referred to as "sealant" layers, are typically manufactured from a commercially-available polyethylene derivative which, when heated, will fuse to itself.

In any event, after the elongated piece 200 of sealable flexible-plastic material is separated from the remainder ("R") of the flexible-plastic material, a portion 204 of the elongated piece 200 of flexible-plastic material is so folded onto the remainder portion 206 of the elongated piece 200 of flexible-plastic material as to form at least three spaced-apart folds 208, 210 and 212 of alternating orientation (STEP 2). The three illustrated folds 208, 210 and 212 are disposed between the opposite ends of the elongated piece 200 of flexible-plastic material. This step—in addition to forming the folds 208, 210 and 212—simultaneously also forms a pair of sidewalls 232 and 233 respectively unitary with the outermost two (i.e., folds 208 and 212) of the three folds 208, 210 and 212. (STEP 2.)

Then, with the one sidewall 232 thus being superposed relative to the other sidewall, and with the flexible-plastic material being folded as described above (see, e.g., STEP 2) so as to cause the sealant layer of the elongated piece 200 of multi-layered flexible-plastic material to be thus-folded onto itself, heat is so applied to the edge margins of the folds 208, 210 and 212, as to provide a rounded bottom 235 (STEP 3).

Alternatively, still other commercially-available multi-layered flexible-plastic materials are so manufactured as to have two sealant layers, one of which is on the inner surface of a thus-folded plastic strip, and the other of which is on the exterior surface of the plastic strip. For such flexible-plastic materials, after the one sidewall has been thus superposed relative to the other sidewall, and after the flexible-plastic material has been so folded as described above in connection with STEP 2, an insulating element (not shown) can be interposed between the end folds up to the middle fold, with small openings being provided on the insulating element for the purpose of providing semi-circular welds within the sideseams; and heat can then be provided to the peripheral edge margins to provide a rounded bottom.

Such bottom-forming procedures are well-known in the pouch-forming art. See, e.g., U.S. Pat. No. 3,380,646 to Doyen et al.

Next, edge margins 221 and 222 of the folds and respective sidewalls (STEP 3) are joined together in a fluid-tight manner for forming in the thermoformable flexible-plastic material a pair of spaced-apart fluid-tight sideseams 236 and 238 (STEP 4A).

The thus-joined edge margins in the vicinity of the folds accordingly define a so-called "gusseted" base 234.

For thermoformable flexible-plastic material having only one inwardly-disposed sealant layer, the above-mentioned circular holes 202 (STEP 1) through the flexible-plastic material enable the leading or front sidewall 232 to be joined directly to the lagging or back sidewall 233 (STEP 2) at the semi-circular regions 218 and 219 of the respective sideseams 236 and 238, for enhancing the stability of the gusseted base 234. Such a procedure, namely to enhance the stability of a gusseted base, is also well-known in the art. Again, see, e.g., U.S. Pat. No. 3,380,646 to Doyen et al.

Sideseam ends 223 and 224 (STEP 4A) which are spaced from the base 234 are closer together than are sideseam ends 225 and 226 which are located adjacent to the base 234.

Still referring to the manufacture of one of the pouch embodiments shown in FIG. 16, a portion 244 of an end margin of front sidewall 232 (STEP 5A) is joined in a fluid-tight manner to the remainder portion 245 of the end margin of front sidewall 232 at the same time that a portion 246 of an end margin of rear sidewall 233 is joined in a fluid-tight manner to the remainder portion 247 of the end margin of the rear sidewall 233 while the sideseam end portions 223 and 224 are proximally joined together in a fluid-tight manner, for collectively forming in the sidewall end margin the fluid-tight endseam 250 (STEP 6A). The preferred manner of forming the endseam 250 is such that the sideseam ends 223 and 224 do not overlap. (See FIG. 8.)

There are, at present, two preferred methods for commercially-producing the pouches shown in FIGS. 16, 17 and 18. One such method, which we prefer to use to make relatively smaller pouches, utilizes the above-discussed procedures except that the pouch is formed on a continuous roll of material called a web. Such a pouch is not cut from or punched out of the web until moving from STEP 4 to STEP 5.

Another such method, which we prefer to use to make relatively larger pouches, again utilizes the above-discussed procedures except that the pouches are formed from three separate webs of flexible plastic material. For example, sidewall 232 would be formed from one web; sidewall 233 would be formed from a second such web; and the bottom piece which includes the fold 210 would be formed from a third such web. In such a pouch-manufacturing method the three webs are sealed together in STEPS 3 and 4 and the thus-formed pouches are then cut from the thus-joined webs, in going from STEP 4 to STEP 5.

Additionally, a fluid container in accordance with certain principles of our present invention may be made as follows.

In particular, an illustrative fluid container may be made by the following illustrative method.

One step of the illustrative method can be space apart two elongated webs of flexible plastic material. (See, for example, FIG. 9 of U.S. Pat. No. 3,380,646 to Doyen et al.) Each such web can have an edge margin.

Another step can be to align the edge margin of one of the webs with the edge margin of the other of the two webs.

Still another step can be to join together the two webs along their aligned edge margins in a manner so as to form a plurality of gusseted bases along the length of the thus-aligned web edge margins.

Or, alternatively, it may be desirable first to dispose a third elongated web of flexible plastic material between the spaced-apart, aligned end margins of the first two webs of flexible plastic material (see, for example, FIGS. 9 and 10 of U.S. Pat. No. 3,380,646 to Doyen et al.; see also FIG. 1 of U.S. Pat. No. 3,980,225 to Kan) and thereafter to join together the three webs along the aligned edge margins of the first two webs in a manner so as to form a plurality of gusseted bases along the length of the thus-aligned edge margins of the first two webs. (See, for example, FIG. 10 of U.S. Pat. No. 3,380,646 to Doyen et al.)

Referring back to the two-web method, another stem can be to form in the two webs, adjacent an edge portion of each respective one of the plural bases and in a direction that is transverse to the thus-joined edge margins of the two webs, a corresponding plurality of spaced-apart sideseams. Adjacent ones of the plural sideseams can be located on opposite ends of each respective one of the plural bases. Each such sideseam can be so formed as to provide a fluid-tight seal between the two webs. The plurality of spaced-apart sideseams could thereby be made a manner so as to provide the first web with a corresponding plurality of first sidewalls between adjacent sideseams. Similarly, the plurality of spaced-apart sideseams could be made in a manner so as to also thereby provide the second web with a corresponding plurality of second sidewalls between adjacent sideseams. Accordingly, each such sidewall of one of the plurality of first and second sidewalls could be made in a manner so as to overlie a corresponding one of the plural sidewalls of the other one of the plurality of first and second sidewalls, as is shown in FIG. 10 of U.S. Pat. No. 3,380,646 to Doyen et al. Alternatively, one skilled in the art can readily envision a closely-spaced side-by-side arrangement that would result by rotating the process shown in FIG. 10 of U.S. Pat. No. 3,380,646 by 90°.

Referring back to the optional, three-web method mentioned above, another alternative step could be to form in the first two webs, adjacent an edge portion of each respective one of the plural bases and in a direction that is transverse to the thus-joined edge margins of the first two webs, a corresponding plurality of spaced-apart sideseams. Adjacent ones of the plural sideseams can be located on opposite ends of each respective one of the plural bases. Each such sideseam can be so formed as to provide a fluid-tight seal between the first two webs. The plurality of spaced-apart sideseams could thereby be made in a manner so as to provide the first web with a corresponding plurality of first sidewalls between adjacent sideseams. Similarly, the plurality of spaced-apart sideseams could be made in a manner so as to also thereby provide the second web with a corresponding plurality of second sidewalls between adjacent sideseams.

More detailed examples of these procedures are disclosed in U.S. Pat. No. 3,980,225 to Kan and in U.S. Pat. No. 3,380,646 to Doyen et al.

Certain principles illustrative of our present invention include the following steps.

Referring back to the above-discussed two-web and optional three-web methods, adjacent sideseam ends located on opposite ends of each respective one of the plural bases can be spaced further apart than adjacent sideseam ends that are located in distal relation to the plural bases.

Still another step is to join a portion of one such sidewall end margin that is located in distal relation to its base in a fluid-tight manner to the remainder portion thereof, yet another step is to join a portion of a closely-spaced sidewall end margin in a fluid-tight manner to the remainder portion thereof, and an additional step is to proximally join together in a fluid-tight manner sideseam end portions that are located in distal relation to such base, for forming in the sidewall end margins opposite such base a fluid-tight endseam, thereby making a fluid container illustrative of our invention.

When utilizing the three-web procedure, all three webs do not have to be the same sealable flexible plastic film. For example, any one flexible plastic film may be different from any other flexible plastic film for a variety of reasons.

If desired, the sideseams 236 and 238 of the pouch can be symmetrically arranged relative to a vertical axis (STEP 4A) so that the transverse cross section of the thus-sealed pouch resembles an isosceles triangle (STEP 6A). Still further, and if desired, one sideseam 236A can include a carrying handle 239, unitary with sideseam 236A (STEP 4B), to enable the thus-sealed pouch to be more-readily carried or otherwise transported. (See, e.g., STEP 6B.) In the alternative, the above-mentioned endseam could be so formed as to include such a handle, if desired. For still other liquid products that are to be contained by the pouch, it may be desirable to produce a pouch that, in transverse cross section, resembles an asymmetrical triangle, in one of its side elevational views (See, e.g., STEP 6C).

While not wanting to be bound by theory, yet desirous of presenting a complete and accurate disclosure, we presently postulate that the following dimensional parameters are of importance if the intention of the pouch manufacturer is to produce from a suitable commercially-available thermoformable multi-layered flexible-plastic material a stand-up pouch having the cross-seal feature disclosed herein, wherein the sidewalls, the base, and the upper margin of the pouch are virtually free of surface distortion as well as other undesirable surface-curvature irregularities.

Accordingly, the various pouch dimensional parameters presented in FIGS. 13, 14 and 15 will now be discussed.

Figures 13, 14, 15:
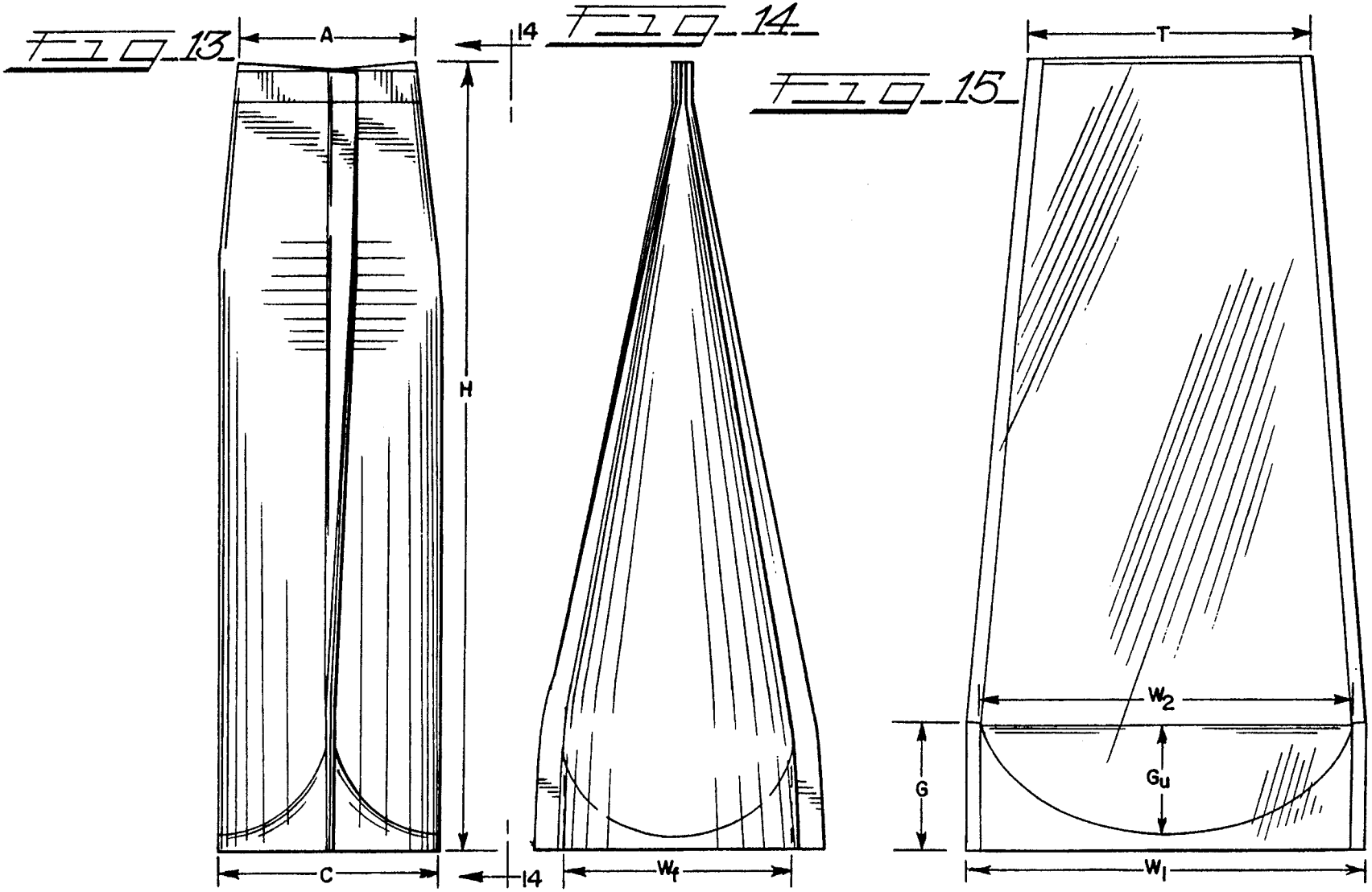
FIG. 13 is a side elevational view, similar to the view of FIG. 6 but on a reduced scale relative thereto, showing certain parameters of the pouch of our present invention.
FIG. 14 is a front elevational view, taken from the plane 14—14 in FIG. 13, showing certain other parameters of the pouch of our present invention.
FIG. 15 is a front elevational view of a "flat" version of the pouch presented in FIG. 14, showing certain additional parameters of the pouch of our present invention. (The above-mentioned FIGS. 1 through 14 all relate to various views of the several, illustrated embodiments of the fluid-containing pouches of our present invention, whereas FIG. 15 relates to an empty pouch.)

FIG. 13 presents a side elevational view of one preferred embodiment of a sealed, fluid-containing pouch of our invention. FIG. 13 is similar to the view shown in FIG. 6 (discussed in detail hereinabove), except that FIG. 13 presents certain dimensional parameters which we have found to be important for producing a fluid-containing pouch that is virtually free of surface distortion as well as other undesirable surface-curvature irregularities. The various pouch dimensional-parameter relationships, that we have found desirable for producing such a pouch, are set forth below in Table I as dimensionless ratios, based upon the depth of the gusseted base ("C").

TABLE I

| Side Elevational View Dimensional Relationships | | | | |
|---|---|---|---|---|
| | | FIG. 13 Dimensional Relationships | | |
| Dimension | Location | Desirable | More Desirable | Most Desirable |
| "A" | Depth of Top Seam | .1C to 3C | .25C to 2C | .5C to 1.5C |
| "C" | Depth of Gusseted Base | — | — | — |
| "H" | Pouch Height | .5C to 12C | .75C to 7C | C to 4C |

FIG. 14 presents a front elevational view of the sealed, fluid-containing pouch, otherwise shown in FIG. 13 in side elevational view. FIG. 14 is somewhat similar to the view shown in FIG. 5 (discussed in detail hereinabove), except that FIG. 14 presents certain dimensional parameters which we have found to be important for producing a fluid-containing pouch that is virtually free of surface distortion as well as other undesirable surface-curvature irregularities. The various pouch dimensional-parameter relationships, that we have found desirable for producing such a pouch, are set forth below in Table II as dimensionless ratios, based upon the depth of the gusseted base ("C"), which is mentioned above in connection with FIG. 13.

TABLE II

| Front Elevational View Dimensional Relationships | | | | |
|---|---|---|---|---|
| | | FIG. 14 Dimensional Relationships | | |
| Dimension | Location | Desirable | More Desirable | Most Desirable |
| "C" | Depth of Gusseted Base | — | — | — |
| "$W_f$" | Width of Fluid-Filled Bottom | C to 6C | 1.25C to 4C | 1.5C to 3.5C |

FIG. 15 presents a front view of a "flattened" pouch (i.e., prior to the introduction of fluid into the pouch). FIG. 15 thus is very similar to the view shown in FIG. 16 (STEP 4A), discussed in detail hereinabove, except that FIG. 15 presents certain dimensional parameters which we have found to be important for producing a fluid-containing pouch that is virtually free of surface distortion as well as other undesirable surface-curvature irregularities. The various pouch dimensional-parameter relationships, that we have found desirable for producing such a pouch, are set forth below in Table III as dimensionless ratios, based upon the depth of the gusseted base ("C"), which is mentioned above in connection with FIG. 13.

TABLE III

| Flat Pouch Dimensional Relationships | | | | |
|---|---|---|---|---|
| | | FIG. 15 Dimensional Relationships | | |
| Dimension | Location | Desirable | More Desirable | Most Desirable |
| "C" | Depth of Gusseted Base | — | — | — |
| "G" | Total Gusset Height | .2C to C | .4C to .8C | .5C to .7C |
| "$G_u$" | Useable Gusset Height | .2C to .5C | .3C to .5C | .4C to .5C |
| "T" | Full Width of Unsealed | .2C to 3.5C | .3C to 2.5C | .5C to 2C |

TABLE III-continued

| Dimension | Location | Flat Pouch Dimensional Relationships: FIG. 15 Dimensional Relationships: Desirable | More Desirable | Most Desirable |
|---|---|---|---|---|
| | Top Margin Including Sideseams | | | |
| "$W_1$" | Full Width of Gusseted Base Including Sideseams | .5C to 8C | .5C to 6C | C to 4.5C |
| "$W_2$" | Width of Gusseted Bottom Excluding Seams | .5C to 7C | .5C to 5C | C to 4C |

The above-noted parameter "G", characterized in Table III above as the total gusset height, is also referred to herein as the gusset sleeve height. Also, the above-noted parameter "$G_u$", characterized in Table III above as the useable gusset height, is otherwise referred to herein as the height of the gusseted bottom.

We have thus found that the above-presented dimensional parameters have enabled us to manufacture a wide assortment of pouches, all possessing our unique "cross-seal" feature. All such pouches, moreover, were virtually free of surface distortion as well as other undesirable surface-curvature irregularities, or were found to possess only relatively minor distortion or surface-curvature irregularities (vis-a-vis commercially-available stand-up pouches representative of the state of the art) when containing from about 10 volume percent ("%") fluid to about 98 volume % fluid, based upon total fluid volume theoretically containable within the sealed pouch.

We have also found that the above-presented dimensional parameters have enabled us to manufacture a wide assortment of fluid-filled multi-layered flexible-plastic pouches that, when stored in an upright manner over a period of 12 to 18 months, exhibit superior shelf-storage stability. That is, our stand-up pouch remained essentially vertical when placed on a horizontal surface, and did not lean, nor did the pouch "tilt" sideways, even when stored in an upright fashion over a period of 12 to 18 months, at a storage temperature which fluctuated between about 25 degrees Celsius to about 45 degrees Celsius. In contradistinction, virtually every fluid-filled prior-art pouch having a stand-up base, that we compared to our pouch was observed to lean or tilt away from the vertical, within 2 months of being placed on a shelf in the upright position and stored at 25° C.

It is our present opinion that it is the lower center of gravity, relative to the prior-art pouches which we observed, together with the unique shape of the pouch of our invention which is responsible for the observations and results reported hereinabove.

For example, it is well known that hydrostatic pressure of a contained fluid, in combination with certain dimensional parameters of the flexible-plastic container or pouch containing such a fluid, will affect the ultimate shape of the fluid-filled pouch. We have observed, surprisingly, that the general configuration of our containers is such that the hydrostatic fluid forces tend to force the sidewalls of a partially-emptied container back to its original fluid-filled shape. Those skilled in the pouch-manufacturing art will, in view of our disclosure, now readily be able to select a suitable flexible-plastic material of sufficient resiliency and strength, to achieve such a result. Indeed, we have observed that the amount of fluid required to cause our pouch to return to its original shape need only be about 10 volume percent ("%") to about 30 volume % of the theoretical full-pouch volume.

Thus, a novel, multi-layered flexible-plastic fluid container or pouch having a cross-seal feature is discussed in detail hereinabove. Also discussed in detail hereinabove are certain methods for making a number of preferred embodiments of such a pouch. While our present invention has been illustrated and described with reference to a number of preferred embodiments, it is to be understood that the present invention is not to be limited to such embodiments. Indeed, a wide assortment of structural alternatives, changes as well as other modifications will become apparent to those skilled in the art upon reading the foregoing description. For example, in addition to the rounded gusseted base which we discussed above, we produced a number of pouches, all possessing our unique cross-seal feature and otherwise within the dimensional parameters discussed above, except that we structurally so altered our gusseted base as to resemble FIGS. 4–7 of U.S. Pat. No. 3,380,646 to Doyen et al. All such structurally-modified pouches, thus incorporating elements of our present invention, possessed sidewalls that were virtually free of surface distortion as well as other undesired surface-curvature irregularities. Such pouches also possessed bases of extraordinary stability when placed upright on a vertical surface at room temperature (25 degrees Celsius) over an extended period of time.

Accordingly, all such structural alternatives, changes and modifications are to be considered as forming a part of our invention insofar as they fall within the spirit and scope of the appended claims.

We claim:

1. A flexible-plastic pouch, adapted for containment of a fluid comprising:

a gusseted bottom having a depth represented by the value C and a width when the pouch is filled represented by the value Wf;

a pair of sidewalls joined to the bottom, each sidewall including edge margins disposed transverse to the bottom and an end margin located in distal relation to the bottom, the edge margins of one sidewall being joined in a fluid-tight manner to the respective edge margins of the other sidewall, thereby defining a pair of spaced-apart fluid-tight sideseams, each sideseam having a respective end portion located opposite the bottom as well as an end portion located adjacent the bottom wherein sideseam ends spaced from the bottom are closer together than sideseam ends adjacent the bottom, a portion of each sidewall end margin being joined in a fluid-tight manner to the remainder portion thereof and the sideseam end portions opposite the bottom being proximally joined together in a fluid-tight manner, thereby collectively defining a fluid-tight endseam having a width represented by the value A; and the bottom defining a base having a geometry sufficient for enabling the sidewalls to remain generally upright relative to a horizontal surface onto which the base has been placed wherein the pouch has a height represented by the value H and wherein the various values are related to each other as follows:

A is equal to from 0.1 C to 1.5 C;

H is equal to from 0.5 C to 12 C; and

Wf is equal to from C to 6 C.

* * * * *